US009954321B2

(12) United States Patent
Wang et al.

(10) Patent No.: US 9,954,321 B2
(45) Date of Patent: Apr. 24, 2018

(54) CARD EDGE CONNECTOR

(71) Applicant: FOXCONN INTERCONNECT TECHNOLOGY LIMITED, Grand Cayman (KY)

(72) Inventors: Xin-Wei Wang, HuaiAn (CN); Guo-Xiang Niu, HuaiAn (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/668,721

(22) Filed: Aug. 4, 2017

(65) Prior Publication Data

US 2018/0040992 A1 Feb. 8, 2018

(30) Foreign Application Priority Data

Aug. 4, 2016 (CN) ..... 2016 2 0835141 U

(51) Int. Cl.

| | |
|---|---|
| ***H01R 12/00*** | (2006.01) |
| ***H01R 13/717*** | (2006.01) |
| ***H01R 12/73*** | (2011.01) |
| ***H01R 12/72*** | (2011.01) |
| ***H01R 12/70*** | (2011.01) |

(52) U.S. Cl.

CPC ..... *H01R 13/7175* (2013.01); *H01R 12/7005* (2013.01); *H01R 12/721* (2013.01); *H01R 12/73* (2013.01)

(58) Field of Classification Search

CPC ..... H01R 12/7076; H01R 13/5025; H01R 13/629; H01R 13/62; H01R 13/7175; H01R 12/7005; H01R 13/64

USPC ..... 439/630, 629, 152, 327, 607.54, 607.1, 439/159, 681

See application file for complete search history.

(56) References Cited

U.S. PATENT DOCUMENTS

| | | | | |
|---|---|---|---|---|
| 5,387,132 A | | 2/1995 | Sarver et al. | |
| 5,478,259 A | * | 12/1995 | Noschese | H01R 23/6873 439/108 |
| 5,688,147 A | * | 11/1997 | Coteus | H01R 12/7005 439/633 |
| 5,842,880 A | * | 12/1998 | Pei | H01R 12/7005 439/327 |
| 5,957,708 A | * | 9/1999 | Lin | H01R 12/7005 439/157 |

(Continued)

FOREIGN PATENT DOCUMENTS

TW M497359 U 3/2015

*Primary Examiner* — Abdullah Riyami
*Assistant Examiner* — Nader Alhawamdeh
(74) *Attorney, Agent, or Firm* — Wei Te Chung; Ming Chieh Chang

(57) ABSTRACT

A card edge connector includes an elongated insulative housing forming a central slot with two rows of terminals disposed by two sides of the central slot and retained in the housing. The housing includes two opposite lengthwise walls and two end walls connected to two opposite ends of the corresponding lengthwise walls, and a bottom wall linked to both the lengthwise walls and the end walls below the central slot. A removable key element is assembled to the two lengthwise walls and intersecting with the central slot. A receiving cavity is formed in the bottom wall to receive a light emitting device located under the key element and mounted upon the printed circuit board on which the connector is seated.

20 Claims, 6 Drawing Sheets

(56) References Cited

U.S. PATENT DOCUMENTS 6,093,046 A * 7/2000 Chiou ..... H01R 12/7005 439/378
6,322,388 B1 * 11/2001 Akio ..... H01R 13/5812 439/459
6,663,402 B1 * 12/2003 Yu ..... H01R 13/65802 439/108
6,672,887 B1 * 1/2004 Yu ..... H01R 13/65802 439/108
6,695,630 B1 * 2/2004 Ku ..... H05K 7/1431 439/152
6,821,149 B2 * 11/2004 Lai ..... H01R 23/6873 439/607.31
7,108,554 B2 * 9/2006 Huang ..... H01R 23/6873 439/378
7,207,815 B1 * 4/2007 Ju ..... H01R 12/7029 439/159
7,442,093 B2 * 10/2008 Li ..... H01R 12/721 439/633
7,491,092 B2 * 2/2009 Zhu ..... H01R 13/6456 439/633
7,771,232 B2 * 8/2010 Si ..... H01R 12/716 439/607.01
8,038,459 B2 * 10/2011 Hayauchi ..... H01R 13/5213 439/301
8,092,239 B2 * 1/2012 Nishiyama ..... H01R 12/7005 439/157
8,794,988 B2 * 8/2014 Tanaka ..... H01R 12/83 439/326
2005/0277334 A1 * 12/2005 Huang ..... H01R 23/6873 439/607.01
2007/0254526 A1 * 11/2007 Lai ..... H05K 1/18 439/637
2010/0323549 A1 * 12/2010 Hayauchi ..... H01R 13/5213 439/357
2012/0135618 A1 * 5/2012 Shen ..... H01R 12/721 439/152
2013/0084723 A1 * 4/2013 Shen ..... H01R 12/7029 439/159
2013/0095679 A1 * 4/2013 Li ..... H01R 12/7005 439/157
2015/0318627 A1 * 11/2015 Berry, Jr. ..... H01R 12/7076 714/6.32
2016/0020539 A1 * 1/2016 Li ..... H01R 12/707 439/155
2016/0020540 A1 * 1/2016 Shen ..... G06F 1/203 439/155

* cited by examiner

CARD EDGE CONNECTOR

BACKGROUND OF THE DISCLOSURE

1. Field of the Disclosure

The invention is related to an electrical connector, and particularly to the card edge connector equipped with a removable key above an LED device.

2. Description of Related Arts

The traditional card edge connector includes an elongated insulative housing defining a central slot with two rows of terminals by two sides wherein a key integrally formed with the housing to function as a foolproof structure for coupling to the notch of the inserted module for identification purpose. Anyhow, there are different type modules defining differently positioned notches, respectively. Because the key is integrally formed with the housing with the same color and same material, in some situations it is somewhat difficult for the user to easily identify the key but mistakenly inserting the incorrect module into the subject card edge connector, thus resulting in damage upon either the module or the key structure of the connector.

It is desired to provide a card edge connector with the strongly distinguishable key element thereof for easy identification purpose.

SUMMARY OF THE DISCLOSURE

To achieve the above desire, a card edge connector includes an elongated insulative housing forming a central slot with two rows of terminals disposed by two sides of the central slot and retained in the housing. The housing includes two opposite lengthwise walls and two end walls connected to two opposite ends of the corresponding lengthwise walls, and a bottom wall linked to both the lengthwise walls and the end walls below the central slot. A removable key element is assembled to the two lengthwise walls and intersecting with the central slot. A receiving cavity is formed in the bottom wall to receive a light emitting device under the key element and mounted upon the printed circuit board on which the connector is seated.

DETAILED DESCRIPTION OF THE PREFERRED EMBODIMENT

Figure 1:
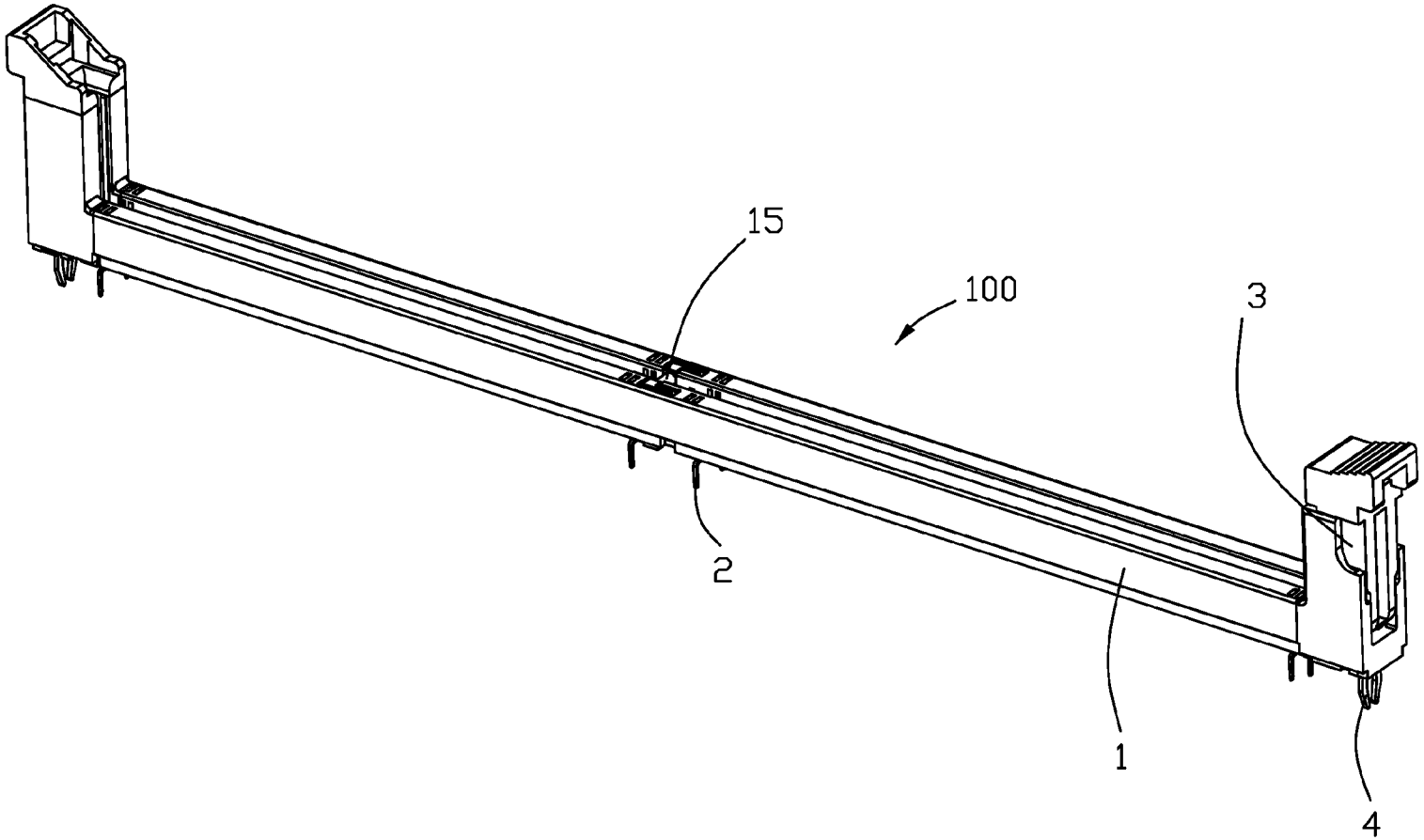
FIG. 1 is a perspective view of an electrical card edge connector of the invention.
Figure 2:
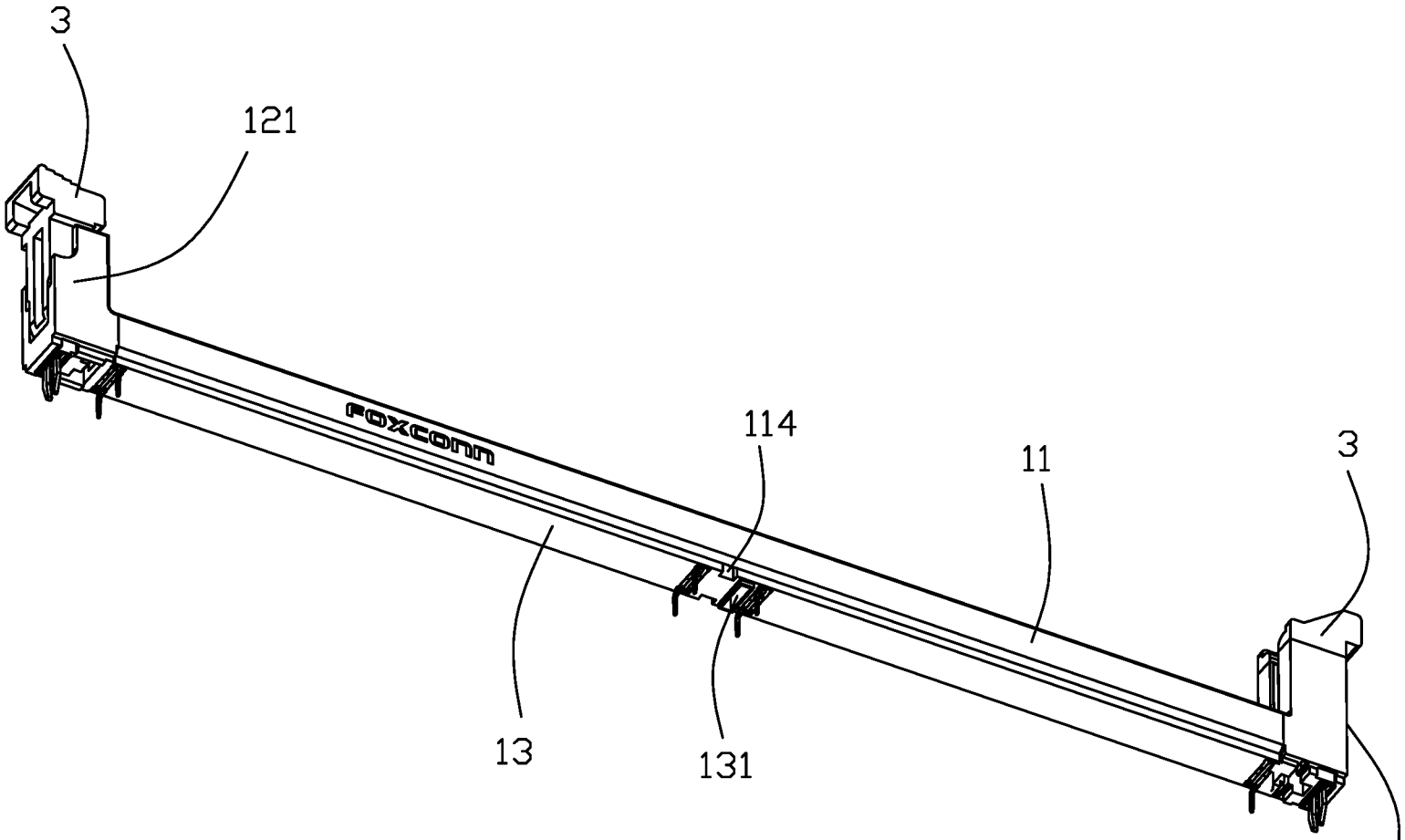
FIG. 2 is another perspective view of the electrical card edge connector of FIG. 1.
Figure 3:
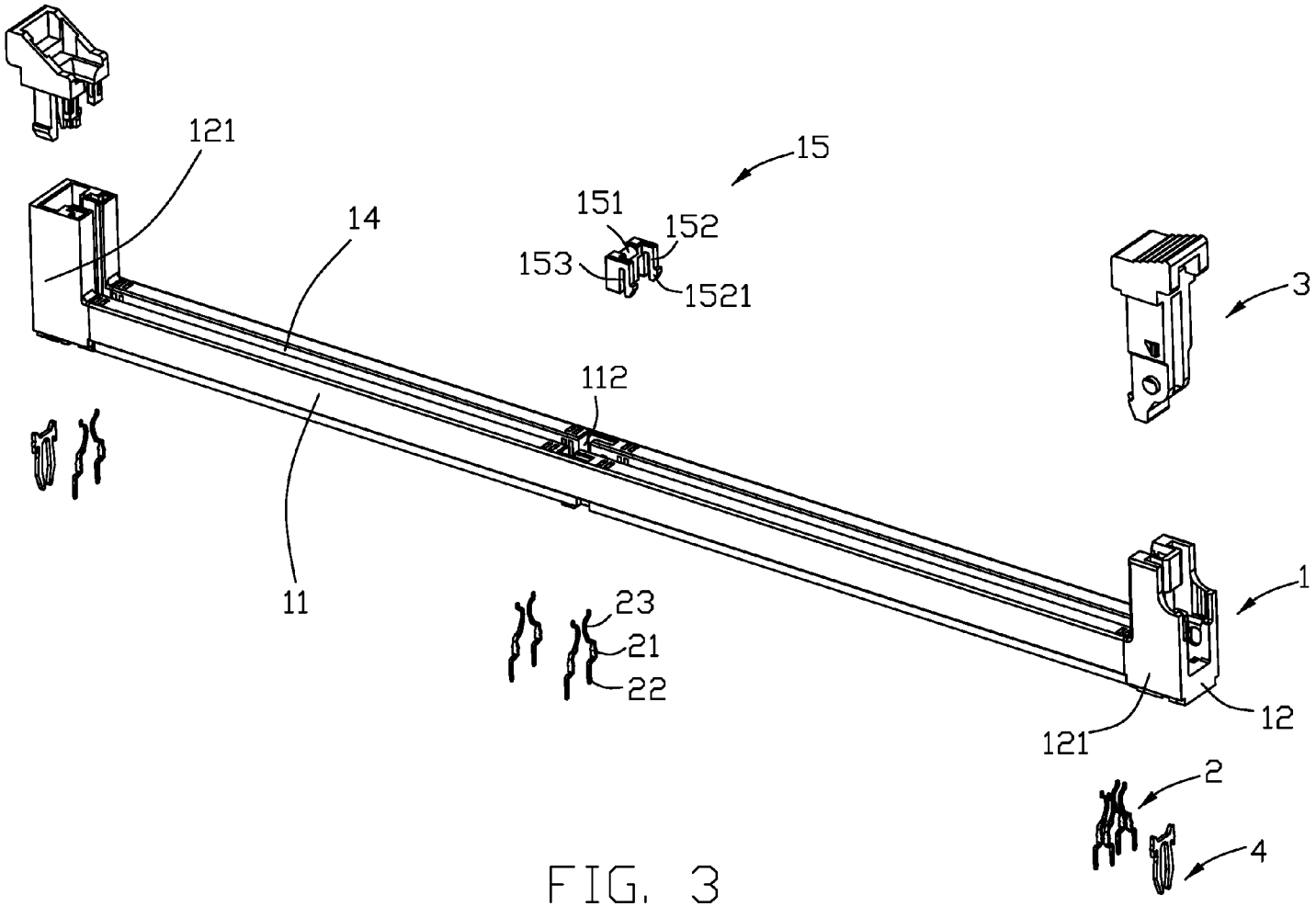
FIG. 3 is a detailed exploded perspective view of the electrical card edge connector of FIG. 1.
Figure 4:
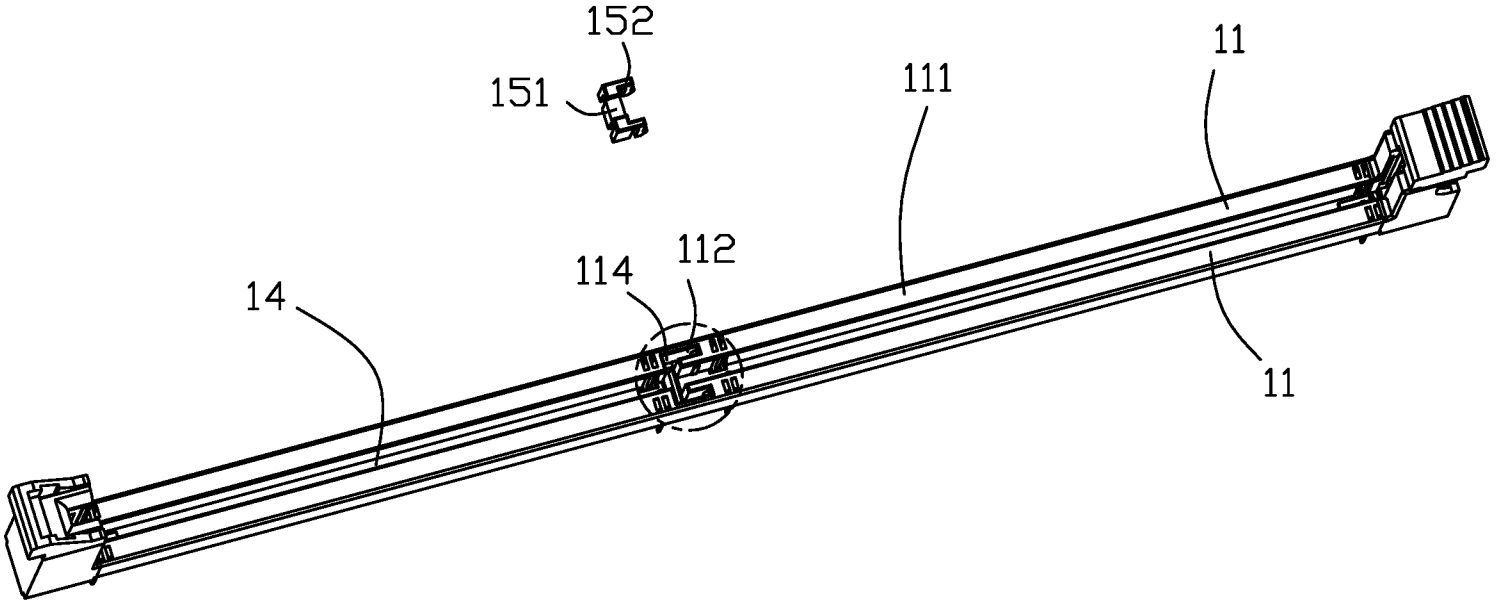
FIG. 4 is an initial exploded perspective view of the electrical card edge connector of FIG. 3.
Figure 5:
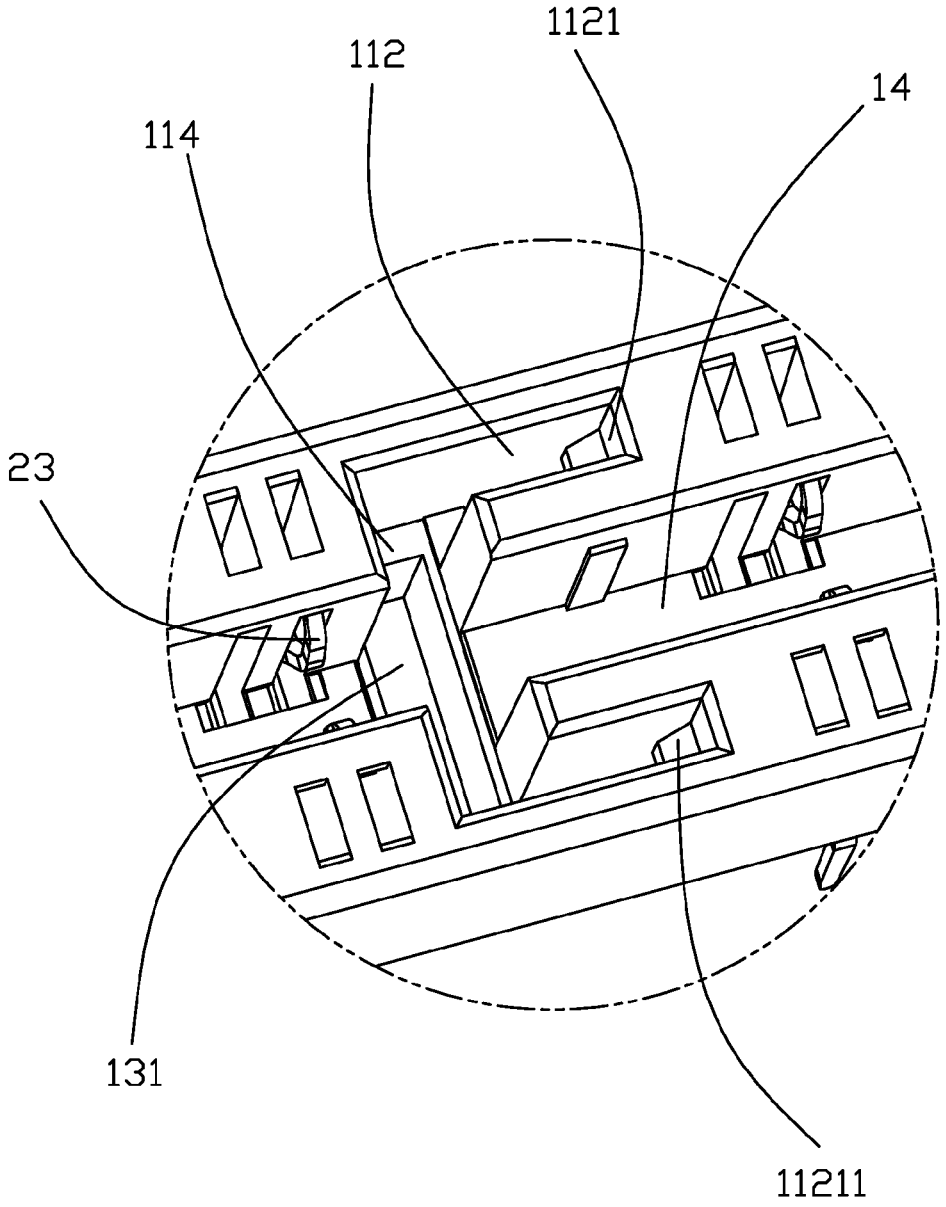
FIG. 5 is an enlarged partial perspective view of the electrical card edge connector of FIG. 4 without the removable key element in the housing.
Figure 6:
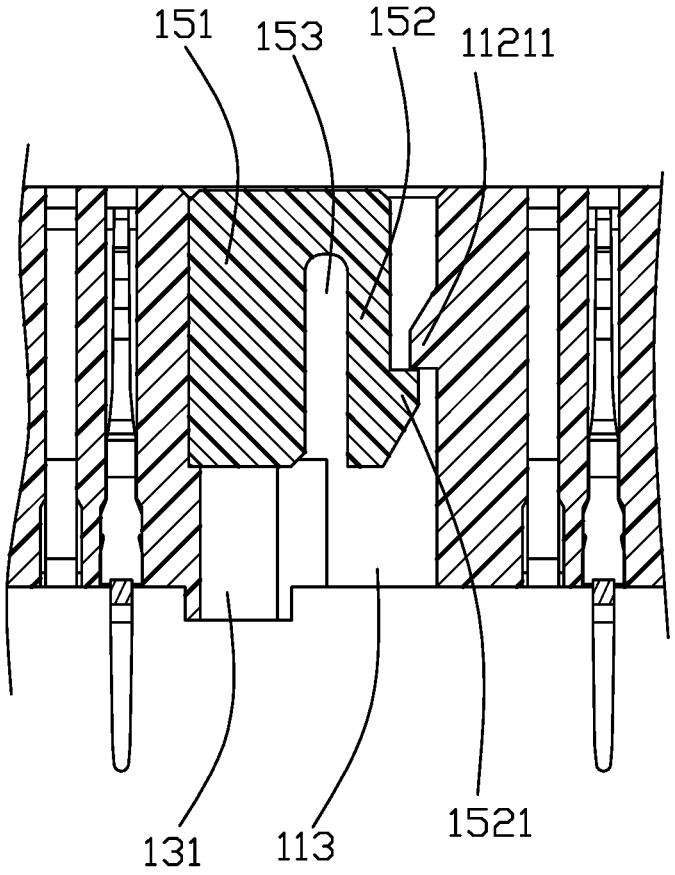
FIG. 6 is an enlarged partial cross-sectional view of the electrical card edge connector of FIG. 4.

Reference will now be made in detail to the embodiments of the present disclosure. Referring to FIGS. 1-6, an electrical card edge connector 100 for mounting to a printed circuit board (not shown), includes an elongated insulative housing 1, two rows of terminals 2 disposed in the housing 1, a pair of latches 3 on two opposite ends of the housing 1, and a plurality of board locks 4 on the bottom face of the housing 1.

The housing 1 includes a pair of lengthwise walls 11, a pair of ends walls 12 connected to both ends of the lengthwise walls 11, and a bottom wall 13 linked to and located below the lengthwise walls 11 and the end walls 12. The lengthwise walls 11, the end walls 12 and the bottom wall 13 commonly form a central slot 14. A key element 15 is located around a middle region in the lengthwise direction. A pair of towers 121 are located at the corresponding end walls 12, respectively. The pair of latches 3 are disposed in the corresponding towers 121, respectively. The pair of board locks 4 are assemble to the bottom wall 13 for securing the connector to the printed circuit board (not shown). The terminal 2 includes a retaining section 21 attached to the lengthwise wall 11, the soldering section 22 extending downwardly from the retaining section 21 beyond the bottom wall 13, and the contacting section 23 extending upwardly from the retaining section 21 into the central slot 14.

The key element 15 can be made with transparent material for better light transmission. The bottom wall 13 forms a receiving cavity 131 under the key element 15 for receiving a light emitting device (not shown) which is mounted upon the printed circuit board (not shown). The light from the light emitting device may be forwarded upward by the transparent key element so as to have the user easily identify the location of the key element for easily coupling the correct module thereto. Notably, the key element 15 may be made with the different color from the housing 1 for easy identification. If the key element 15 may be assembled to the housing 1 via insert-molding process because the different colors or the different material therebetween, Anyhow, the removable design for the key element 15 is preferred for implementing the different material or different color arrangement with regard to the housing 1.

In the presently preferred embodiment, the key element 15 is removable and includes a main body 151, which extends perpendicular to the pair of lengthwise walls 11 and is configured and dimensioned to comply with the notch of the inserted memory module (not shown), and a pair of resilient locking arms 152 which essentially extend downwardly with a gap 153 from the main body 151 in a deflectable manner with a locking head 1521. Correspondingly, the housing 1 forms a pair of receiving grooves 112 to receive the corresponding locking arms 152, respectively. The receiving groove 112 includes an abutment wall 1121 against which the resilient locking arm 152 abuts. The abutment wall 1121 further forms a protrusion 11211 against which the locking head 1521 abuts so as to secure the key element 15 in position in the housing 1. Notably, both the locking head 1521 and the protrusion 11211 form tapered structures opposite to each other for easy assembling the key element 15 into the housing 1. The receiving cavity 112 extends downwardly from the upper face 111 of the lengthwise wall 11 therethrough either downwardly or sidewardly so as to allow an external tool (not shown) to be thereinto either upwardly or inwardly/laterally to release engagement between the locking head 1521 and the protrusion 11211. An operation recess 113 is formed in the bottom face and is spaced from the receiving cavity 131 for strength consideration. The upper face forms a receiving space 114 to receive the main body 151.

In brief, the key element 15, disregarding whether it is transparent or of a different color from the housing 1, can be easily identified by the user due to light emitted from the light emitting device which is received in the receiving cavity 131. It should be noted that in this embodiment, the light emitting device may be essentially a light emitting device assembly having a light waveguide received within the receiving cavity 131 and associated with thereunder an LED mounted upon the printed circuit board While a preferred embodiment in accordance with the present disclosure has been shown and described, equivalent modifications and changes known to persons skilled in the art according to the spirit of the present disclosure are considered within the scope of the present disclosure as described in the appended claims.

What is claimed is:

1. A card edge connector for mounting to a printed circuit board, comprising:

an elongated insulative housing having opposite lengthwise walls extending along a longitudinal direction, opposite end walls linked to both ends of each of said lengthwise walls and extending in a transverse direction perpendicular to said longitudinal direction, and a bottom wall linked to both said lengthwise walls and the end walls to commonly form a central slot extending upwardly to an exterior in a vertical direction perpendicular to both said longitudinal direction and the transverse direction;

two rows of terminals disposed in the corresponding lengthwise walls, respectively, by two sides of the central slot;

a removable key element detachably attached to a middle region of the housing along the longitudinal direction; and a light emitting device receiving in a receiving cavity of the housing under said key element and adapted to be mounted to the printed circuit board.

2. The card edge connector as claimed in claim 1, wherein said key element includes a main body dimensioned extending in the transverse direction and dimensioned to be receiving in a corresponding notch of the printed circuit board, and a pair of resilient locking arms extending from two ends of the main body in the longitudinal direction, and each of said locking arms is equipped with a locking head engaged with a corresponding protrusion form on the housing.

3. The card edge connector as claimed in claim 2, wherein the main body perpendicularly intersects with the central slot while the resilient locking arm extends parallel to the central slot.

4. The card edge connector as claimed in claim 2, wherein the housing forms a receiving space to receive the main body of the key element, and a pair of receiving grooves in the respective lengthwise walls to receive the corresponding resilient locking arms, respectively.

5. The card edge connector as claimed in claim 2, wherein the protrusion is formed in the receiving groove.

6. The card edge connector as claimed in claim 2, wherein the housing forms an operation recess under the protrusion so as to allow an external tool to release engagement between the locking head and the protrusion through said operation recess.

7. The card edge connector as claimed in claim 6, wherein said operation recess is separated from the receiving cavity.

8. The card edge connector as claimed in claim 1, wherein the key element is transparent.

9. The card edge connector as claimed in claim 1, wherein the light emitting device extends.

10. A card edge connector for mounting to a printed circuit board, comprising:

an elongated insulative housing having opposite lengthwise walls extending along a longitudinal direction, opposite end walls linked to both ends of each of said lengthwise walls and extending in a transverse direction perpendicular to said longitudinal direction, and a bottom wall linked to both said lengthwise walls and the end walls to commonly form a central slot extending upwardly to an exterior in a vertical direction perpendicular to both said longitudinal direction and the transverse direction;

two rows of terminals disposed in the corresponding lengthwise walls, respectively, by two sides of the central slot;

a key element located around a middle region of the housing along the longitudinal direction; and a light emitting device receiving in a receiving cavity of the housing under said key element and adapted to be mounted to the printed circuit board.

11. The card edge connector as claimed in claim 9, wherein said key element is transparent.

12. The card edge connector as claimed in claim 10, wherein said light emitting device is fully covered by the key element in the vertical direction.

13. The card edge connector as claimed in claim 10, wherein the key element is removably secured to the housing via at least one resilient locking arm.

14. The card edge connector as claimed in claim 12, wherein one of said lengthwise walls defines a receiving groove to receive said resilient locking arm.

15. The card edge connector as claimed in claim 13, wherein the housing forms an operation recess in the bottom wall to disengage the resilient locking arm from the housing.

16. The card edge connector as claimed in claim 13, wherein a protrusion is formed in the receiving groove to lock a locking head of the resilient locking arm.

17. A card edge connector for mounting to a printed circuit board, comprising:

an elongated insulative housing having opposite lengthwise walls extending along a longitudinal direction, opposite end walls linked to both ends of each of said lengthwise walls and extending in a transverse direction perpendicular to said longitudinal direction, and a bottom wall linked to both said lengthwise walls and the end walls to commonly form a central slot extending upwardly to an exterior in a vertical direction perpendicular to both said longitudinal direction and the transverse direction;

two rows of terminals disposed in the corresponding lengthwise walls, respectively, by two sides of the central slot;

a removable key element detachably attached to a middle region of the housing along the longitudinal direction; and a light emitting device located in the housing under said key element and adapted to be mounted to the printed circuit board.

18. The card edge connector as claimed in claim 17, wherein said key element includes a main body dimensioned extending in the transverse direction and dimensioned to be receiving in a corresponding notch of the printed circuit board, and a pair of resilient locking arms extending from two ends of the main body in the longitudinal direction, and each of said locking arms is equipped with a locking head engaged with a corresponding protrusion form on the housing.

19. The card edge connector as claimed in claim 18, wherein the main body perpendicularly intersects with the central slot while the resilient locking arm extends parallel to the central slot.

20. The card edge connector as claimed in claim 18, wherein the housing forms a receiving space to receive the main body of the key element, and a pair of receiving grooves in the respective lengthwise walls to receive the corresponding resilient locking arms, respectively.

* * * * *